US011663982B2

(12) United States Patent
Choe et al.

(10) Patent No.: US 11,663,982 B2
(45) Date of Patent: May 30, 2023

(54) DISPLAY DEVICE

(71) Applicant: Samsung Display Co., Ltd., Yongin-si (KR)

(72) Inventors: Eun Gyeong Choe, Yongin-si (KR); Jin Wook Yang, Yongin-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 0 days.

(21) Appl. No.: 17/735,028

(22) Filed: May 2, 2022

(65) Prior Publication Data

US 2022/0262321 A1 Aug. 18, 2022

Related U.S. Application Data

(63) Continuation of application No. 17/326,299, filed on May 20, 2021, now Pat. No. 11,322,098, which is a (Continued)

(30) Foreign Application Priority Data

Oct. 2, 2018 (KR) ..... 10-2018-0117788

(51) Int. Cl.
*G09G 3/3291* (2016.01)
*G09G 3/3258* (2016.01)

(52) U.S. Cl.
CPC ..... *G09G 3/3291* (2013.01); *G09G 3/3258* (2013.01); *G09G 2300/0809* (2013.01)

(58) Field of Classification Search
None
See application file for complete search history.

(56) References Cited

U.S. PATENT DOCUMENTS 9,773,454 B2 9/2017 Kim
2006/0290646 A1 12/2006 Kang
(Continued)

FOREIGN PATENT DOCUMENTS

KR 10-2015-0025537 3/2015
KR 10-2016-0092530 8/2016
(Continued)

OTHER PUBLICATIONS

Non-Final Office Action dated Oct. 7, 2020, issued in U.S. Appl. No. 16/538,824.
(Continued)

*Primary Examiner* — Nicholas J Lee
(74) *Attorney, Agent, or Firm* — H.C. Park & Associates, PLC

(57) ABSTRACT

A display device including first to eighth pixels successively arranged in a first direction on a first horizontal line, and first to sixteenth data lines each extending in a second direction and successively arranged in the first direction, in which the second and third data lines are disposed between the first and second pixels and respectively connected to the first and second pixels, the sixth and seventh data lines are disposed between the third and fourth pixels and respectively connected to the third and fourth pixels, the tenth and eleventh data lines are disposed between the fifth and sixth pixels and respectively connected to the fifth and sixth pixels, the fourteenth and fifteenth data lines are disposed between the seventh and eighth pixels and respectively connected to the seventh and eighth pixels.

16 Claims, 12 Drawing Sheets

Related U.S. Application Data continuation of application No. 16/538,824, filed on Aug. 13, 2019, now Pat. No. 11,017,728.

(56) References Cited

U.S. PATENT DOCUMENTS

| | | | |
|---|---|---|---|
| 2016/0217744 | A1 | 7/2016 | Song et al. |
| 2017/0076665 | A1 | 3/2017 | Kim |

FOREIGN PATENT DOCUMENTS

| | | |
|---|---|---|
| KR | 10-2017-0031323 | 3/2017 |
| KR | 10-2020-0017614 | 2/2020 |

OTHER PUBLICATIONS

Notice of Allowance dated Apr. 22, 2021, issued in U.S. Appl. No. 16/538,824.

Notice of Allowance dated Jan. 7, 2022, issued in U.S. Appl. No. 17/326,299.

DISPLAY DEVICE

CROSS-REFERENCE TO RELATED APPLICATIONS

This application is a Continuation of U.S. application Ser. No. 17/326,299 filed May 20, 2021, which is a Continuation of U.S. application Ser. No. 16/538,824, filed Aug. 13, 2019, each of which claims priority to and the benefit of Korean Patent Application No. 10-2018-0117788, filed on Oct. 2, 2018, each of which is hereby incorporated by reference for all purposes as if fully set forth herein.

BACKGROUND

Field

Exemplary embodiments of the invention relate to a display device.

Discussion of the Background

With the development of information technology, the importance of a display device that is a connection medium between a user and information has been emphasized. Owing to the importance of the display device, the use of various display devices, such as a liquid crystal display (LCD) device and an organic light-emitting display device, has increased.

An organic light-emitting display device displays an image using organic light-emitting diodes which generate light by recombination of electrons and holes. The organic light-emitting display device is advantageous in that it has a high response speed and is able to display a clear image.

Such an organic light-emitting display device includes pixels, a data driver configured to supply data voltages to the pixels, a scan driver configured to supply scan signals to the pixels, and an emission driver configured to supply emission control signals to the pixels.

Adjacent pixels having different colors may be grouped, and each group may be defined as a dot. Each dot may express various colors by combinations of colors.

The above information disclosed in this Background section is only for understanding of the background of the inventive concepts, and, therefore, it may contain information that does not constitute prior art.

SUMMARY

Devices constructed according to exemplary implementations of the invention are capable of providing a display device capable of preventing or reducing crosstalk between data lines.

Additional features of the inventive concepts will be set forth in the description which follows, and in part will be apparent from the description, or may be learned by practice of the inventive concepts.

According to one or more embodiments of the invention, a display device includes: a first dot and a second dot arranged on a first horizontal line in a first direction, each of the first dot and the second dot including a first pixel, a second pixel, a third pixel, and a fourth pixel successively arranged in the first direction; and a switch unit configured to selectively couple a first output line, a second output line, a third output line, and a fourth output line respectively to the first pixel, the second pixel, the third pixel, and the fourth pixel of each of the first dot and the second dot, in response to a first control signal and a second control signal. During a first period in response to receiving the first control signal, the switch unit may be configured to couple the first output line to the first pixel of the first dot, couple the second output line to the second pixel of the first dot, couple the third output line to the third pixel of the first dot, and couple the fourth output line to the fourth pixel of the first dot. During a second period in response to receiving the second control signal, the switch unit may be configured to couple the first output line to the third pixel of the second dot, couple the second output line to the second pixel of the second dot, couple the third output line to the first pixel of the second dot, and couple the fourth output line to the fourth pixel of the second dot.

The first pixel may be configured to emit light of a first color, the second pixel may be configured to emit light of a second color, the third pixel may be configured to emit light of a third color, the fourth pixel may be configured to emit light of a fourth color, wherein the first color, the second color, and the third color may be different from each other.

The first color may be red, the second color and the fourth color may be green, and the third color may be blue.

The display device may further include a third dot and a fourth dot arranged on a second horizontal line in the first direction, each of the third dot and the fourth dot including the third pixel, the fourth pixel, the first pixel, and the second pixel successively arranged in the first direction. The second horizontal line may be adjacent to the first horizontal line in a second direction, the second direction being different from the first direction.

During a third period, in response to receiving a third control signal, the switch unit may be configured to couple the first output line to the first pixel of the third dot, couple the second output line to a second pixel of an adjacent dot, couple the third output line to the third pixel of the third dot, and couple the fourth output line to the fourth pixel of the third dot. During a fourth period, in response to receiving a fourth control signal, the switch unit may be configured to couple the first output line to the third pixel of the fourth dot, couple the second output line to the second pixel of the third dot, couple the third output line to the first pixel of the fourth dot, and couple the fourth output line to the fourth pixel of the fourth dot. The adjacent dot may be arranged adjacent to the third dot in the first direction.

During a third period, in response to receiving a third control signal, the switch unit may be configured to couple the first output line to the first pixel of the third dot, couple the second output line to the second pixel of the fourth dot, and couple the third output line to the third pixel of the third dot. During a fourth period, in response to receiving a fourth control signal, the switch unit may be configured to couple the first output line to the third pixel of the fourth dot, couple the second output line to the second pixel of the third dot, couple the third output line to the first pixel of the fourth dot, and couple the fourth output line to the fourth pixel of the fourth dot.

The display device may further include a scan driver configured to supply a first scan signal to the first dot and the second dot during a first write period and supply a second scan signal to the third dot and the fourth dot during a second write period. The first period, the second period, the first write period, the third period, the fourth period, and the second write period may sequentially proceed.

The first horizontal line may indicate an odd-number-th horizontal line, and the second horizontal line may indicate an even-number-th horizontal line.

The second period and the first write period may overlap with each other. The fourth period and the second write period may partially overlap with each other.

The display device may further include a data driver configured to supply data voltages to the first output line, the second output line, the third output line, and the fourth output line in a time-sharing manner.

The data driver may include: a data processor configured to generate data signals corresponding to the first output line, the second output line, the third output line, and the fourth output line, based on second data; and a first digital-to-analog converter (DAC), a second DAC, a third DAC, and a fourth DAC configured to convert the data signals into the data voltages. Each of the first to fourth DACs may be supplied with a corresponding one of first to fourth gamma voltages.

During the first period, the first DAC may be configured to supply a data voltage to be applied to the first pixel of the first dot to the first output line, the second DAC may be configured to supply a data voltage to be applied to the second pixel of the first dot to the second output line, the third DAC may be configured to supply a data voltage to be applied to the third pixel of the first dot to the third output line, and the fourth DAC may be configured to supply a data voltage to be applied to the fourth pixel of the first dot to the fourth output line. During the second period, the first DAC may be configured to supply a data voltage to be applied to the third pixel of the second dot to the third output line, the second DAC may be configured to supply a data voltage to be applied to the second pixel of the second dot to the second output line, the third DAC may be configured to supply a data voltage to be applied to the first pixel of the second dot to the first output line, and the fourth DAC may be configured to supply a data voltage to be applied to the fourth pixel of the second dot to the fourth output line.

The display device may further include a timing controller configured to supply the first control signal and the second control signal to the switch unit.

According to one or more embodiments of the invention, a display device includes: a first dot and a second dot arranged on a first horizontal line in a first direction, each of the first dot and the second dot including a first pixel, a second pixel, a third pixel, and a fourth pixel; a switch unit configured to selectively couple a first output line, a second output line, a third output line, and a fourth output line respectively to the first pixel, the second pixel, the third pixel, and the fourth pixel of each of the first dot and the second dot, in response to a first control signal and a second control signal; and a data driver configured to supply data voltages to the first to fourth output lines in a time-sharing manner. The data driver may include: a data processor configured to generate data signals corresponding to the first to fourth output lines; and a first digital-to-analog converter (DAC), a second DAC, a third DAC, and a fourth DAC configured to convert the data signals into the data voltages. Each of the first to fourth DACs may be supplied with a corresponding one of first to fourth gamma voltages.

In response to receiving the first control signal during a first period, the first DAC may be configured to supply a data voltage to be applied to the first pixel of the first dot to the first output line, the second DAC may be configured to supply a data voltage to be applied to the second pixel of the first dot to the second output line, the third DAC may be configured to supply a data voltage to be applied to the third pixel of the first dot to the third output line, and the fourth DAC may be configured to supply a data voltage to be applied to the fourth pixel of the first dot to the fourth output line.

In response to receiving the second control signal during a second period, the first DAC is configured to supply a data voltage to be applied to the third pixel of the second dot to the first output line, the second DAC may be configured to supply a data voltage to be applied to the second pixel of the second dot to the second output line, the third DAC may be configured to supply a data voltage to be applied to the first pixel of the second dot to the third output line, and the fourth DAC may be configured to supply a data voltage to be applied to the fourth pixel of the second dot to the fourth output line.

According to one or more embodiments of the invention, a display device includes: a first dot and a second dot arranged on a first horizontal line in a first direction, each of the first dot and the second dot including a first pixel, a second pixel, and a third pixel successively arranged in the first direction; a third dot and a fourth dot arranged on a second horizontal line in the first direction, each of the third and the fourth dots including the third pixel, the first pixel, and the second pixel successively arranged in the first direction; a switch unit configured to selectively couple a first output line, a second output line, and a third output line respectively to the first pixel, the second pixel, and the third pixel of each of the first dot and the second dot, in response to a first control signal supplied during a first period and a second control signal supplied during a second period; and a data driver configured to supply data voltages to the first to third output lines in a time-sharing manner. The data driver may include: a data processor configured to generate data signals corresponding to the first to third output lines; and a first digital-to-analog converter (DAC), a second DAC, and a third DAC configured to convert the data signals into the data voltages. Each of the first to third DACs may be supplied with a corresponding one of first to third gamma voltages. The second horizontal line may be adjacent to the first horizontal line in a second direction, the second direction being different from the first direction. The first pixel may be configured to emit light of a first color, the second pixel may be configured to emit light of a second color, the third pixel may be configured to emit light of a third color. The first color, the second color, and the third color may be different from each other.

During the first period, the first DAC may be configured to supply a data voltage to be applied to the first pixel of the first dot to the first output line, the second DAC may be configured to supply a data voltage to be applied to the second pixel of the first dot to the second output line, and the third DAC may be configured to supply a data voltage to be applied to the third pixel of the first dot to the third output line. The switch unit may be configured to couple the first output line to the first pixel of the first dot, couple the second output line to the second pixel of the first dot, and couple the third output line to the third pixel of the first dot.

During the second period, the first DAC may be configured to supply a data voltage to be applied to the third pixel of the second dot to the third output line, the second DAC may be configured to supply a data voltage to be applied to the second pixel of the second dot to the second output line, and the third DAC may be configured to supply a data voltage to be applied to the first pixel of the second dot to the first output line. The switch unit may be configured to couple the first output line to the third pixel of the second dot, couple the second output line to the second pixel of the second dot, and couple the third output line to the first pixel of the second dot.

During a third period in which a third control signal is supplied, the first DAC may be configured to supply a data voltage to be applied to the first pixel of the third dot to the first output line, the second DAC may be configured to supply a data voltage to be applied to a second pixel of an adjacent dot to the second output line, and the third DAC may be configured to supply a data voltage to be applied to the third pixel of the third dot to the third output line. The switch unit may be configured to couple the first output line to the first pixel of the third dot, couple the second output line to the second pixel of the adjacent dot, and couple the third output line to the third pixel of the third dot. The adjacent dot may be arranged adjacent to the third dot in the first direction.

During a third period in which a third control signal is supplied, the first DAC may be configured to supply a data voltage to be applied to the first pixel of the third dot to the first output line, the second DAC may be configured to supply a data voltage to be applied to the second pixel of the fourth dot to the second output line, and the third DAC may be configured to supply a data voltage to be applied to the third pixel of the third dot to the third output line. The switch unit may be configured to couple the first output line to the first pixel of the third dot, couple the second output line to the second pixel of the fourth dot, and couple the third output line to the third pixel of the third dot.

According to the exemplary embodiments, a display device having a structure in which two data lines are disposed between two adjacent pixels in accordance with an exemplary embodiment, crosstalk between the data lines may be prevented or reduced.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate exemplary embodiments of the invention, and together with the description serve to explain the inventive concepts.

DETAILED DESCRIPTION

Figure 1:
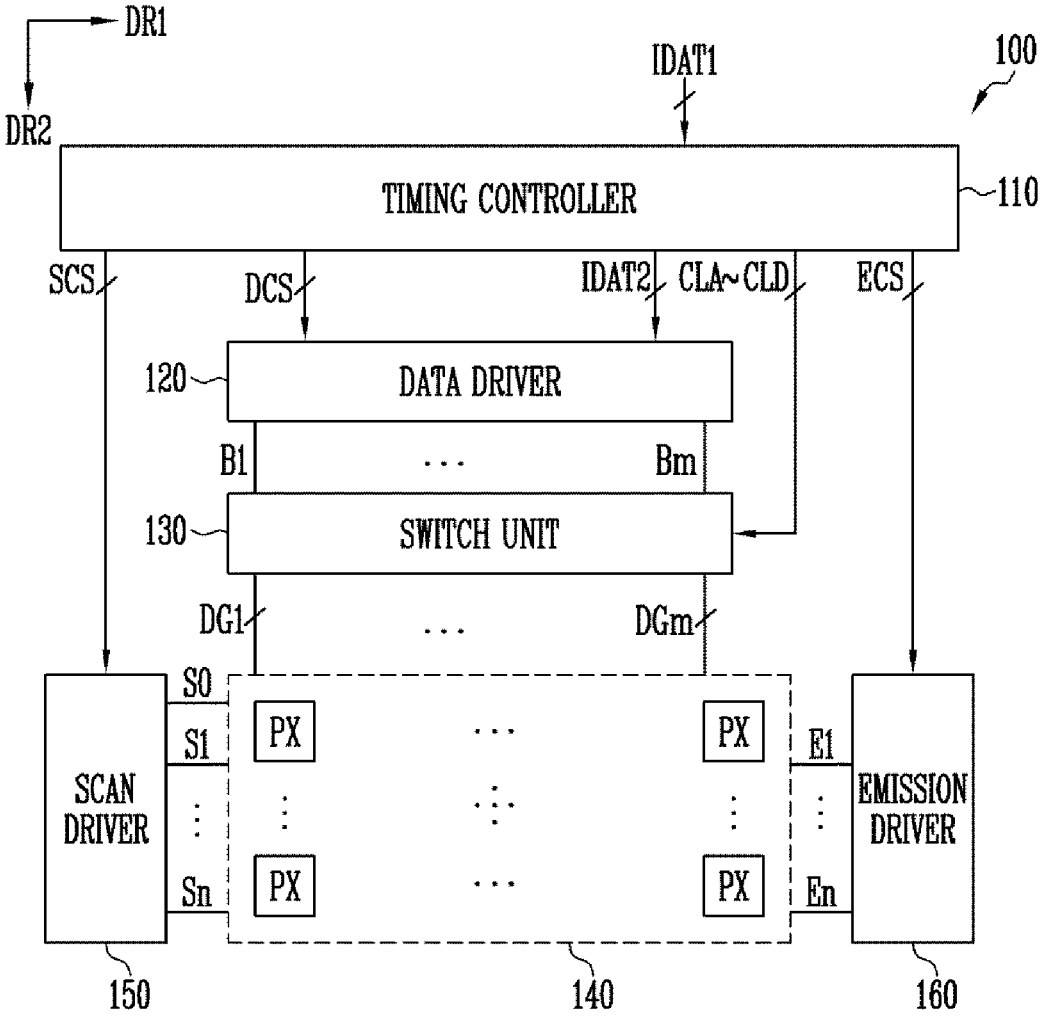
FIG. 1 is a block diagram illustrating a display device in accordance with an exemplary embodiment.

In the following description, for the purposes of explanation, numerous specific details are set forth in order to provide a thorough understanding of various exemplary embodiments or implementations of the invention. As used herein "embodiments" and "implementations" are interchangeable words that are non-limiting examples of devices or methods employing one or more of the inventive concepts disclosed herein. It is apparent, however, that various exemplary embodiments may be practiced without these specific details or with one or more equivalent arrangements. In other instances, well-known structures and devices are shown in block diagram form in order to avoid unnecessarily obscuring various exemplary embodiments. Further, various exemplary embodiments may be different, but do not have to be exclusive. For example, specific shapes, configurations, and characteristics of an exemplary embodiment may be used or implemented in another exemplary embodiment without departing from the inventive concepts.

Unless otherwise specified, the illustrated exemplary embodiments are to be understood as providing exemplary features of varying detail of some ways in which the inventive concepts may be implemented in practice. Therefore, unless otherwise specified, the features, components, modules, layers, films, panels, regions, and/or aspects, etc. (hereinafter individually or collectively referred to as "elements"), of the various embodiments may be otherwise combined, separated, interchanged, and/or rearranged without departing from the inventive concepts.

The use of cross-hatching and/or shading in the accompanying drawings is generally provided to clarify boundaries between adjacent elements. As such, neither the presence nor the absence of cross-hatching or shading conveys or indicates any preference or requirement for particular materials, material properties, dimensions, proportions, commonalities between illustrated elements, and/or any other characteristic, attribute, property, etc., of the elements, unless specified. Further, in the accompanying drawings, the size and relative sizes of elements may be exaggerated for clarity and/or descriptive purposes. When an exemplary embodiment may be implemented differently, a specific process order may be performed differently from the described order. For example, two consecutively described processes may be performed substantially at the same time or performed in an order opposite to the described order. Also, like reference numerals denote like elements.

When an element, such as a layer, is referred to as being "on," "connected to," or "coupled to" another element or layer, it may be directly on, connected to, or coupled to the other element or layer or intervening elements or layers may be present. When, however, an element or layer is referred to as being "directly on," "directly connected to," or "directly coupled to" another element or layer, there are no intervening elements or layers present. To this end, the term "connected" may refer to physical, electrical, and/or fluid connection, with or without intervening elements. Further, a DR1 direction and a DR2 direction are not limited to two axes of a rectangular coordinate system, such as the x and y axes, and may be interpreted in a broader sense. For example, the DR1 direction and the DR2 direction may be perpendicular to one another, or may represent different directions that are not perpendicular to one another. For the purposes of this disclosure, "at least one of X, Y, and Z" and "at least one selected from the group consisting of X, Y, and Z" may be construed as X only, Y only, Z only, or any combination of two or more of X, Y, and Z, such as, for instance, XYZ, XYY, YZ, and ZZ. As used herein, the term "and/or" includes any and all combinations of one or more of the associated listed items.

Although the terms "first," "second," etc. may be used herein to describe various types of elements, these elements should not be limited by these terms. These terms are used to distinguish one element from another element. Thus, a first element discussed below could be termed a second element without departing from the teachings of the disclosure.

Spatially relative terms, such as "beneath," "below," "under," "lower," "above," "upper," "over," "higher," "side" (e.g., as in "sidewall"), and the like, may be used herein for descriptive purposes, and, thereby, to describe one elements relationship to another element(s) as illustrated in the drawings. Spatially relative terms are intended to encompass different orientations of an apparatus in use, operation, and/or manufacture in addition to the orientation depicted in the drawings. For example, if the apparatus in the drawings is turned over, elements described as "below" or "beneath" other elements or features would then be oriented "above" the other elements or features. Thus, the exemplary term "below" can encompass both an orientation of above and below. Furthermore, the apparatus may be otherwise oriented (e.g., rotated 90 degrees or at other orientations), and, as such, the spatially relative descriptors used herein interpreted accordingly.

The terminology used herein is for the purpose of describing particular embodiments and is not intended to be limiting. As used herein, the singular forms, "a," "an," and "the" are intended to include the plural forms as well, unless the context clearly indicates otherwise. Moreover, the terms "comprises," "comprising," "includes," and/or "including," when used in this specification, specify the presence of stated features, integers, steps, operations, elements, components, and/or groups thereof, but do not preclude the presence or addition of one or more other features, integers, steps, operations, elements, components, and/or groups thereof. It is also noted that, as used herein, the terms "substantially," "about," and other similar terms, are used as terms of approximation and not as terms of degree, and, as such, are utilized to account for inherent deviations in measured, calculated, and/or provided values that would be recognized by one of ordinary skill in the art.

As customary in the field, some exemplary embodiments are described and illustrated in the accompanying drawings in terms of functional blocks, units, and/or modules. Those skilled in the art will appreciate that these blocks, units, and/or modules are physically implemented by electronic (or optical) circuits, such as logic circuits, discrete components, microprocessors, hard-wired circuits, memory elements, wiring connections, and the like, which may be formed using semiconductor-based fabrication techniques or other manufacturing technologies. In the case of the blocks, units, and/or modules being implemented by microprocessors or other similar hardware, they may be programmed and controlled using software (e.g., microcode) to perform various functions discussed herein and may optionally be driven by firmware and/or software. It is also contemplated that each block, unit, and/or module may be implemented by dedicated hardware, or as a combination of dedicated hardware to perform some functions and a processor (e.g., one or more programmed microprocessors and associated circuitry) to perform other functions. Also, each block, unit, and/or module of some exemplary embodiments may be physically separated into two or more interacting and discrete blocks, units, and/or modules without departing from the scope of the inventive concepts. Further, the blocks, units, and/or modules of some exemplary embodiments may be physically combined into more complex blocks, units, and/or modules without departing from the scope of the inventive concepts.

Unless otherwise defined, all terms (including technical and scientific terms) used herein have the same meaning as commonly understood by one of ordinary skill in the art to which this disclosure is a part. Terms, such as those defined in commonly used dictionaries, should be interpreted as having a meaning that is consistent with their meaning in the context of the relevant art and should not be interpreted in an idealized or overly formal sense, unless expressly so defined herein.

It is to be noted that the present disclosure is not limited to the exemplary embodiments but can be embodied in various other ways. In this specification, "connected/coupled" refers to one component not only directly coupling another component but also indirectly coupling another component through an intermediate component. Reference now should be made to the drawings, in which the same reference numerals are used throughout the different drawings to designate the same or similar components.

FIG. 1 is a block diagram illustrating a display device 100 in accordance with an exemplary embodiment.

Referring to FIG. 1, the display device 100 may include a timing controller 110, a data driver 120, a switch unit 130, a pixel unit 140, a scan driver 150, and an emission driver 160.

The timing controller 110 may control overall operations of the display device 100.

The timing controller 110 may receive first data IDAT1 and external control signals from an external device. For example, the first data IDAT1 may refer to an image received from the external device. The external control signals may include a vertical synchronization signal, a horizontal synchronization signal, a main clock signal, a data enable signal, and so forth.

The timing controller 110 may realign the first data IDAT1. When needed, the timing controller 110 may compensate for the first data IDAT1, based on compensation data (e.g., degradation or spot data).

The timing controller 110 may generate second data IDAT2 by realigning or compensating for the first data IDAT1. The timing controller 110 may generate a data driving control signal DCS, a scan control signal SCS, an emission driving control signal ECS, and control signals CLA, CLB, CLC, and CLD, based on at least one of the first data IDAT1 and the external control signals.

The timing controller 110 may transmit the second data IDAT2 and the data driving control signal DCS to the data driver 120. For example, the data driving control signal DCS may include image data, a frame control signal, and a clock signal.

The timing controller 110 may transmit the control signals CLA, CLB, CLC, and CLD to the switch unit 130. For example, the control signals CLA, CLB, CLC, and CLD may turn on or off switches included in the switch unit 130. In this specification, supply of the control signals CLA, CLB, CLC, and CLD may indicate that the control signals CLA, CLB, CLC, and CLD have gate-on voltages capable of turning on the corresponding switches.

The timing controller 110 may transmit the scan control signal SCS to the scan driver 150. For example, the scan control signal SCS may include a scan start signal and at least one scan clock signal. The scan start signal may control supply timings of scan signals, and the scan clock signal may be used to shift the scan start signal.

The timing controller 110 may transmit the emission driving control signal ECS to the emission driver 160. For example, the emission driving control signal ECS may include an emission start signal and clock signals. The emission start signal may control a supply timing of an emission control signal, and the clock signals may be used to shift the emission start signal.

The data driver 120 may receive the second data IDAT2 and the data driving control signal DCS from the timing controller 110.

The data driver 120 may supply data voltages to output lines B1 to Bm (m is a natural number), based on the second data IDAT2 and the data driving control signal DCS. In an exemplary embodiment, the data driver 120 may supply data voltages to the output lines B1 to Bm in a time-sharing manner during a horizontal period. For example, the data driver 120 may supply the data voltages to the output lines B1 to Bm such that the data voltages are synchronized with corresponding scan signals. In an exemplary embodiment, the data driver 120 may include a plurality of data driving ICs (integrated circuits).

In this specification, the term "data voltage" may indicate a voltage corresponding to a data signal.

The switch unit 130 may receive the data voltages from the output lines B1 to Bm. The switch unit 130 may receive the control signals CLA, CLB, CLC, and CLD.

The switch unit 130 may supply, in response to the control signals CLA, CLB, CLC, and CLD, data voltages supplied to any one of the output lines B1 to Bm to a plurality of data line groups (at least two of DG1 to DGm) during a horizontal period.

In an exemplary embodiment, the switch unit 130 may mean a demultiplexer. Details pertaining to this will be explained later herein with reference to FIGS. 4A and 4B.

The pixel unit 140 may include a substrate, and pixels PX disposed on the substrate. In an exemplary embodiment, the pixel unit 140 may indicate a display region of a display panel.

The pixels PX may be coupled to corresponding scan lines S0 to Sn (n is a natural number), corresponding emission control lines E1 to En, and the corresponding data line groups DG1 to DGm. The pixels PX may be arranged in various ways to be connected with the corresponding scan lines S0 to Sn, the corresponding emission control lines E1 to En, and the corresponding data line groups DG1 to DGm. The pixels PX may be supplied with scan signals through the scan lines S0 to Sn. The pixels PX may be supplied with emission control signals through the emission control lines E1 to En. The pixels PX may be supplied with data voltages through the data line groups DG1 to DGm. Each pixel PX may emit light at a gray level corresponding to a corresponding data voltage.

In an exemplary embodiment, the output lines B1 to Bm and the data line groups DG1 to DGm may extend in a second direction (e.g., DR2 in a vertical direction). The scan lines S0 to Sn and the emission control lines E1 to En may extend in a first direction (e.g., DR1 in a horizontal direction) different from the second direction. In an exemplary embodiment, each of the pixels PX may be coupled to at least one of the scan lines S0 to Sn and coupled to at least one of the data line groups DG1 to DGm.

The scan driver 150 may receive the scan control signal SCS from the timing controller 110. The scan driver 150 may supply scan signals to the scan lines S0 to Sn, based on the scan control signal SCS. For example, the scan driver 150 may sequentially supply the scan signals to the scan lines S0 to Sn. In an exemplary embodiment, each scan signal may have a gate-on voltage.

The emission driver 160 may receive the emission driving control signal ECS from the timing controller 110. The emission driver 160 may supply emission control signals to the emission control lines E1 to En, based on the emission driving control signal ECS. For example, the emission driver 160 may sequentially supply the emission control signals to the emission control lines E1 to En. In an exemplary embodiment, each emission control signal may have a gate-on voltage.

FIG. 1 illustrates n+1 scan lines S0 to Sn and n emission control lines E1 to En, but the exemplary embodiments of the present disclosure are not limited thereto. For instance, dummy scan lines and/or dummy emission control lines may be additionally formed to ensure the reliability of the operation.

Furthermore, FIG. 1 illustrates that the timing controller 110, the data driver 120, the switch unit 130, the scan driver 150, and the emission driver 160 are separately provided, but at least some of the foregoing components may be integrated with each other, as needed.

The timing controller 110, the data driver 120, the switch unit 130, the scan driver 150, and the emission driver 160 may be installed using any one of various forms, e.g., a chip-on-glass form, a chip-on-plastic form, a tape carrier package form, and a chip-on-film form.

Figure 2:
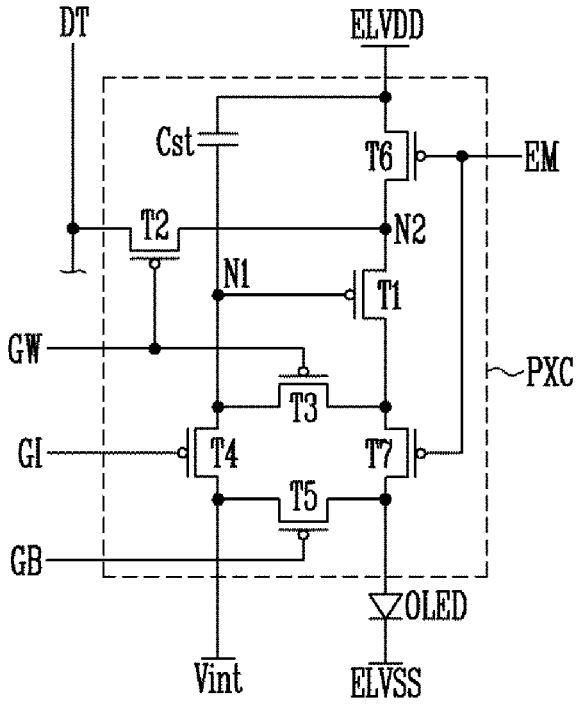
FIG. 2 is an equivalent circuit diagram illustrating a pixel in accordance with an exemplary embodiment.

FIG. 2 is an equivalent circuit diagram illustrating a pixel PX in accordance with an exemplary embodiment. FIG. 2 illustrates a circuit of the pixel PX in accordance with an exemplary embodiment, and this circuit may be applied to each of the first to fourth pixels PX1, PX2, PX3, and PX4 illustrated in FIG. 4A to 4B. Although FIG. 2 illustrates an exemplary circuit structure of the pixel PX, the exemplary embodiments of the present disclosure are not limited thereto.

Referring to FIG. 2, the pixel PX may include a pixel circuit PXC and an organic light-emitting diode OLED.

An anode electrode of the organic light-emitting diode OLED may be coupled to the pixel circuit PXC, and a cathode electrode thereof may be coupled to a second power supply ELVSS. The organic light-emitting diode OLED may emit light having a predetermined luminance corresponding to driving current supplied from the pixel circuit PXC. A first power supply ELVDD may be set to a voltage higher than that of the second power supply ELVSS to allow current to flow to the organic light-emitting diode OLED.

The pixel circuit PXC may control, in response to a data voltage DT supplied to the corresponding data line, driving current flowing from the first power supply ELVDD to the second power supply ELVSS via the organic light-emitting diode OLED. To this end, the pixel circuit PXC may include a first transistor T1, a second transistor T2, a third transistor T3, a fourth transistor T4, a fifth transistor T5, emission control transistors (i.e., a sixth transistor T6 and a seventh transistor T7), and a storage capacitor Cst.

Here, a first node N1 may be a common node which is coupled to a gate electrode of the first transistor T1, the storage capacitor Cst, the third transistor T3, and the fourth transistor T4.

A second node N2 may be a common node which is coupled to the first transistor T1, the second transistor T2, and the sixth transistor T6.

A first electrode of the first transistor (driving transistor) T1 may be coupled to the second node N2, and a second electrode thereof may be coupled to the anode electrode of the organic light-emitting diode OLED. A gate electrode of the first transistor T1 may be coupled to the first node N1. The first transistor T1 may control, in response to a voltage supplied to the first node N1, driving current flowing from the first power supply ELVDD to the second power supply ELVSS via the organic light-emitting diode OLED.

The second transistor T2 may be coupled between the data line and the second node N2. A gate electrode of the second transistor T2 may be coupled to a first scan line to which a first scan signal GW is supplied. When the first scan signal GW is supplied to the first scan line, the second transistor T2 may be turned on so that the data line can be coupled with the second node N2. Hence, the data voltage DT may be supplied to the second node N2. The first scan line may be any one of the scan lines S0 to Sn illustrated in FIG. 1. In an exemplary embodiment, the first scan line may be an i-th scan line (i is a natural number).

The third transistor T3 may be coupled between the second electrode of the first transistor T1 and the first node N1. A gate electrode of the third transistor T3 may be coupled to the first scan line to which the first scan signal GW is supplied. When the first scan signal GW is supplied to the first scan line, the third transistor T3 may be turned on so that the first transistor T1 can be connected in the form of a diode. Hence, the data voltage DT supplied to the second node N2 may be supplied to the first node N1. In an exemplary embodiment, the third transistor T3 may be embodied using a transistor having dual gates.

The fourth transistor T4 may be coupled between a third power supply Vint and the first node N1. A gate electrode of the fourth transistor T4 may be coupled to a second scan line. When a second scan signal GI is supplied to the second scan line, the fourth transistor T4 may be turned on so that the voltage of the third power supply Vint can be supplied to the first node N1. In an exemplary embodiment, the fourth transistor T4 may be embodied using a transistor having dual gates. The second scan line may be any one of the scan lines S0 to Sn illustrated in FIG. 1. In an exemplary embodiment, the second scan line may be an (i−1)-th scan line.

The fifth transistor T5 may be coupled between the third power supply Vint and the anode electrode of the organic light-emitting diode OLED. A gate electrode of the fifth transistor T5 may be coupled to a third scan line. When a third scan signal GB is supplied to the third scan line, the fifth transistor T5 may be turned on so that the voltage of the third power supply Vint can be supplied to the anode electrode of the organic light-emitting diode OLED. The voltage of the third power supply Vint may be set to a voltage lower than the data voltage. In an exemplary embodiment, the third scan signal GB may be equal to the first scan signal GW or the second scan signal GI.

The third scan line may be any one of the scan lines S0 to Sn illustrated in FIG. 1. In an exemplary embodiment, the third scan line may be the i-th scan line or an (i+1)-th scan line.

The emission control transistors may be disposed on a path along which driving current flows, and may apply the driving current in response to an emission control signal supplied to an emission control line.

For example, the emission control transistors may include the sixth transistor (first emission control transistor) T6, and the seventh transistor (second emission control transistor) T7.

The sixth transistor T6 may be coupled between the first power supply ELVDD and the second node N2. A gate electrode of the sixth transistor T6 may be coupled to the emission control line. The sixth transistor T6 may be turned on when an emission control signal EM is supplied to the emission control line.

The seventh transistor T7 may be coupled between the second electrode of the first transistor T1 and the anode electrode of the organic light-emitting diode OLED. A gate electrode of the seventh transistor T7 may be coupled to the emission control line. The seventh transistor T7 may be turned on when the emission control signal EM is supplied to the emission control line.

The storage capacitor Cst may be coupled between the first power supply ELVDD and the first node N1. The storage capacitor Cst may store a voltage corresponding to both the data voltage and the threshold voltage of the first transistor T1.

In the present disclosure, the organic light-emitting diode OLED may generate light having various colors including red, green, and blue in response to the amount of current supplied from the driving transistor, but the exemplary embodiments of the present disclosure are not limited thereto. For instance, the OLED may generate white light depending on the amount of current supplied from the drive transistor. In this case, a separate color filter or the like may be used to embody a color image.

Although FIG. 2 illustrates that each of the first to seventh transistors T1, T2, T3, T4, T5, T6, and T7 is a P-type transistor, i.e., a P-channel metal-oxide-semiconductor (P-MOS) transistor, the exemplary embodiments of the present disclosure are not limited thereto. In some embodiments, at least one of the first to seventh transistors T1, T2, T3, T4, T5, T6, and T7 may be implemented as an N-type transistor or a P-type transistor.

Figure 3:
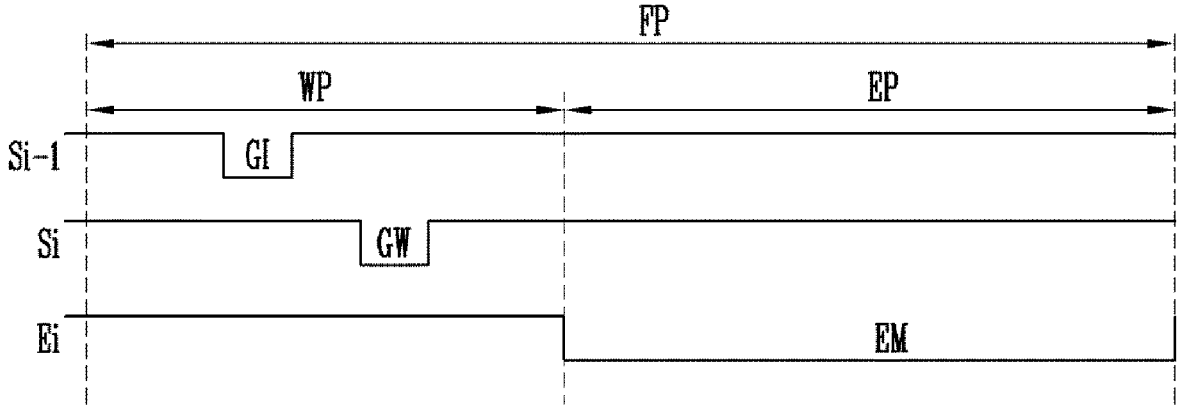
FIG. 3 is a signal diagram illustrating a method of driving the display device in accordance with an exemplary embodiment.

FIG. 3 is a signal diagram illustrating a method of driving the display device 100 (refer to FIG. 1) in accordance with an exemplary embodiment.

Particularly, FIG. 3 illustrates the first scan signal GW, the second scan signal GI, and the emission control signal EM during a frame period FP.

FIG. 3 illustrates an exemplary embodiment in which the first scan signal GW is supplied through an i-th scan line Si (i is a natural number), and the second scan signal GI is supplied through an i−1-th scan line Si−1. However, the present disclosure is not limited to this. Furthermore, for the sake of explanation, the third scan signal GB of FIG. 2 is not separately illustrated in FIG. 3 because it is equal to the first scan signal GW, but the exemplary embodiments of the present disclosure are not limited thereto.

Referring to FIGS. 1, 2, and 3, the display device 100 may be driven in the unit of the frame period FP.

The frame period FP may include a non-emission period WP and an emission period EP.

During the non-emission period WP, the scan signals GI and GW may be sequentially supplied to the i−1-th scan line Si−1 and the i-th scan line Si.

During the emission period EP, the emission control signal EM may be supplied to the i-th emission control line Ei.

When the second scan signal GI is supplied to the i−1-th scan line Si−1, the fourth transistor T4 may be turned on.

When the fourth transistor T4 is turned on, the first node N1 may be initialized to the voltage of the third power supply Vint.

Subsequently, when the first scan signal GW is supplied to the i-th scan line Si, the second transistor T2, the third transistor T3, and the fifth transistor T5 may be turned on.

When the second transistor T2 is turned on, the data voltage DT supplied to the data line may be applied to the second node N2. The data voltage DT applied to the second node N2 may be applied to the second electrode of the first transistor T1 via the first transistor T1. The threshold voltage of the first transistor T1 may be reflected in the data voltage DT. For example, a voltage obtained by subtracting the threshold voltage of the first transistor T1 from the data voltage DT may be applied to the second electrode of the first transistor T1.

When the third transistor T3 is turned on, the voltage of the second electrode of the first transistor T1 may be applied to the first node N1 via the third transistor T3, and the storage capacitor Cst may store the voltage of the first node N1.

When the fifth transistor T5 is turned on, the anode electrode of the organic light-emitting diode OLED may be initialized to the voltage of the third power supply Vint.

During the emission period EP, when the emission control signal EM is supplied to the i-th emission control line Ei, the sixth transistor T6 and the seventh transistor T7 may be turned on.

If the sixth transistor T6 and the seventh transistor T7 are turned on, driving current may flow via the organic light-emitting diode OLED. Here, the organic light-emitting diode OLED may generate light corresponding to the driving current. Therefore, the pixel PX may emit light.

Figure 4A:
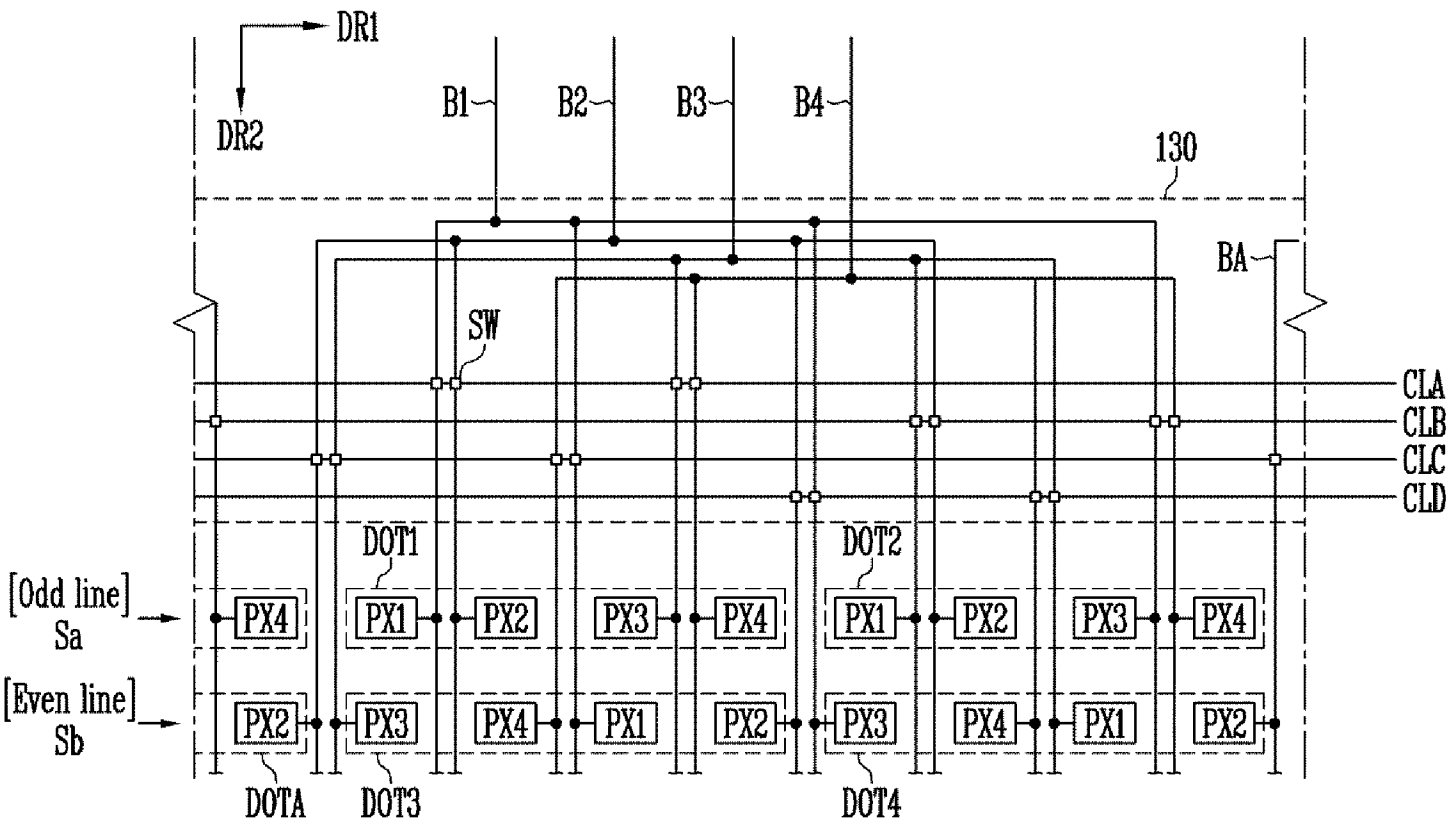
FIGS. 4A and 4B are circuit diagrams illustrating a switch unit in accordance with exemplary embodiments.
Figure 4B:
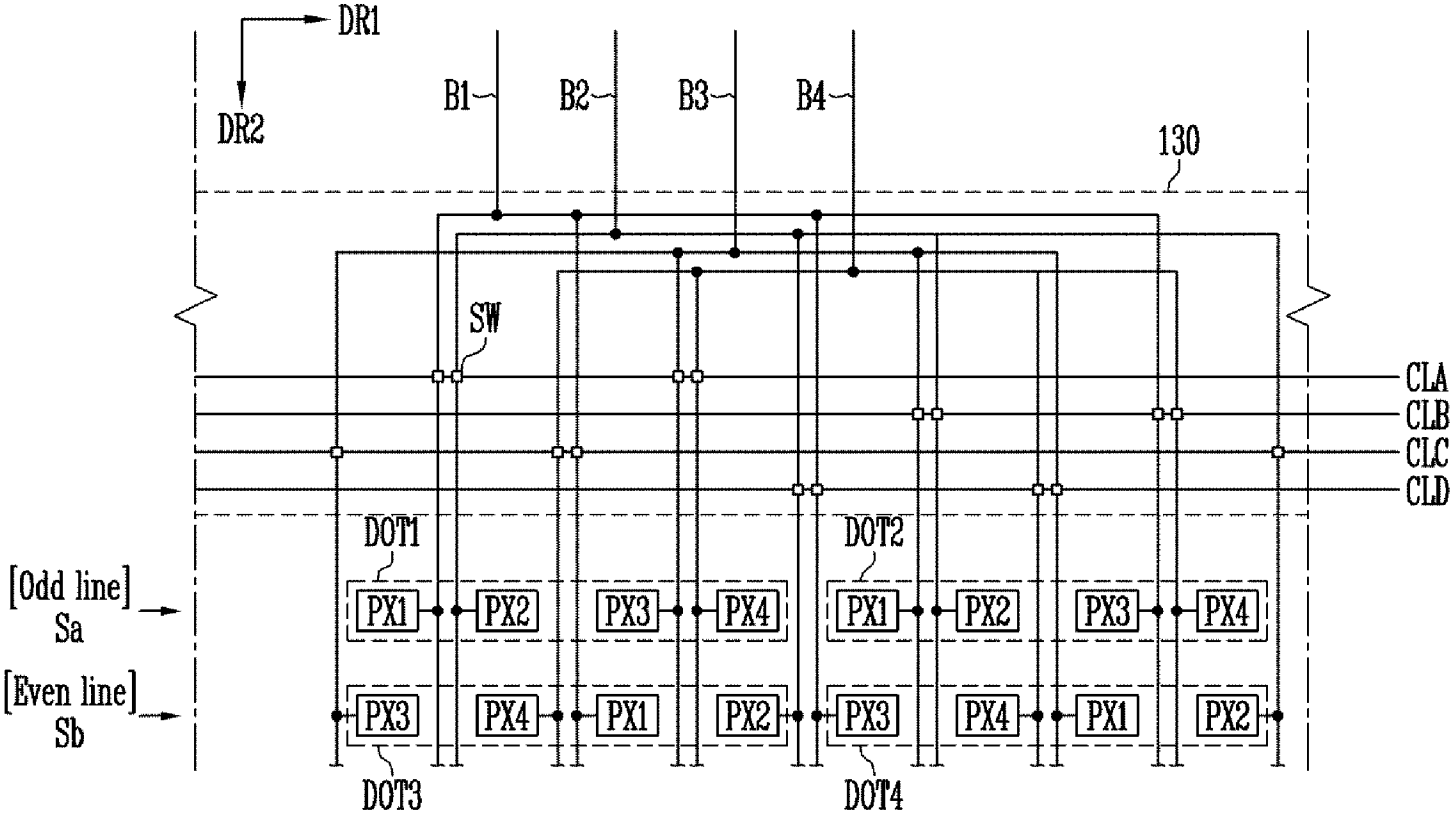

FIGS. 4A and 4B are circuit diagrams illustrating the switch unit 130 in accordance with exemplary embodiments.

For the sake of explanation, each of FIGS. 4A and 4B representatively illustrate a unit area of the switch unit 130. Therefore, the following description may also be applied to other areas of the switch unit 130 that are not illustrated in FIGS. 4A and 4B.

Adjacent pixels each having a different single color may be grouped, and each group may be defined as a dot. Each dot may express various colors by combinations of different colors. A picture, a character, etc. of an image frame may be expressed on a dot basis.

Referring to FIGS. 4A and 4B, a first dot DOT1 and a second dot DOT2 may be arranged in a first direction DR1 on a first horizontal line. The first horizontal line may mean an odd-number-th horizontal line. The first horizontal line may correspond to a first scan line Sa. In other words, the second dot DOT2 may be adjacent to the first dot DOT1 in the first direction DR1.

A third dot DOT3 and a fourth dot DOT4 may be arranged in the first direction DR1 on a second horizontal line. The second horizontal line may mean an even-number-th horizontal line. The second horizontal line may correspond to a second scan line Sb. In other words, the fourth dot DOT4 may be adjacent to the third dot DOT3 in the first direction DR1. The second horizontal line may be adjacent to the first horizontal line in a second direction DR2 different from the first direction DR1.

Each of the first dot DOT1, the second dot DOT2, the third dot DOT3, and the fourth dot DOT4 may include a first pixel PX1, a second pixel PX2, a third pixel PX3, and a fourth pixel PX4.

The first pixel PX1, the second pixel PX2, the third pixel PX3, and the fourth pixel PX4 of the first dot DOT1 may be successively arranged in the first direction DR1.

The first pixel PX1, the second pixel PX2, the third pixel PX3, and the fourth pixel PX4 of the second dot DOT2 may be successively arranged in the first direction DR1.

The first pixel PX1, the second pixel PX2, the third pixel PX3, and the fourth pixel PX4 of the third dot DOT3 may be successively arranged in the first direction DR1.

The first pixel PX1, the second pixel PX2, the third pixel PX3, and the fourth pixel PX4 of the fourth dot DOT4 may be successively arranged in the first direction DR1.

The first pixel PX1 may emit light of a first color, the second pixel PX2 may emit light of a second color, the third pixel PX3 may emit light of a third color, and the fourth pixel PX4 may emit light of a fourth color. For example, the first color, the second color, and the third color may be different from each other. The second color and the fourth color may be equal to each other. In an exemplary embodiment, the first color may be red, the second color and the fourth color may be green, and the third color may be blue.

The switch unit 130 may include a plurality of switches SW.

The switch unit 130 may be coupled to a first output line B1, a second line B2, a third output line B3, and a fourth output line B4. The switch unit 130 may receive, through the first output line B1, the second line B2, the third output line B3, and the fourth output line B4, corresponding data voltages.

The switch unit 130 may receive a first control signal CLA, a second control signal CLB, a third control signal CLC, and a fourth control signal CLD.

The switch unit 130 may selectively couple the first output line B1, the second line B2, the third output line B3, and the fourth output line B4, respectively, to the first pixel PX1, the second pixel PX2, the third pixel PX3, and the fourth pix PX4 of each of the first and second dots DOT1 and DOT2, based on the first control signal CLA and the second control signal CLB.

In addition, the switch unit 130 may selectively couple the first output line B1, the second line B2, the third output line B3, and the fourth output line B4, respectively, to the third pixel PX3, the fourth pix PX4, the first pixel PX1, and the second pixel PX2 of each of the third and fourth dots DOT3 and DOT4, based on the third control signal CLC and the fourth control signal CLD.

In detail, during a first period in which the first control signal CLA is supplied, the switch unit 130 may couple the first output line B1 to the first pixel PX1 of the first dot DOT1, couple the second output line B2 to the second pixel PX2 of the first dot DOT1, couple the third output line B3 to the third pixel PX3 of the first dot DOT1, and couple the fourth output line B4 to the fourth pixel PX4 of the first dot DOT1.

During a second period in which the second control signal CLB is supplied, the switch unit 130 may couple the first output line B1 to the third pixel PX3 of the second dot DOT2, couple the second output line B2 to the second pixel PX2 of the second dot DOT2, couple the third output line B3 to the first pixel PX1 of the second dot DOT2, and couple the fourth output line B4 to the fourth pixel PX4 of the second dot DOT2.

In accordance with an exemplary embodiment illustrated in FIG. 4A, during a third period in which the third control signal CLC is supplied, the switch unit 130 may couple the first output line B1 to the first pixel PX1 of the third dot DOT3, couple the second output line B2 to a second pixel PX2 of an adjacent dot DOTA, couple the third output line B3 to the third pixel PX3 of the third dot DOT3, couple the fourth output line B4 to the fourth pixel PX4 of the third dot DOT3, and couple an adjacent output line BA to the second pixel PX2 of the fourth dot DOT4.

Here, the adjacent output line BA may refer to an output line disposed adjacent to the fourth output line B4 in the first direction. The adjacent dot DOTA may refer to a dot that is disposed on the second horizontal line and adjacent to the third dot DOT3. The third dot DOT3 may be adjacent to the adjacent dot DOTA in the first direction DR1.

In accordance with an exemplary embodiment illustrated in FIG. 4B, during a third period in which the third control signal CLC is supplied, the switch unit 130 may couple the first output line B1 to the first pixel PX1 of the third dot DOT3, couple the second output line B2 to the second pixel PX2 of the fourth dot DOT4, couple the third output line B3 to the third pixel PX3 of the third dot DOT3, and couple the fourth output line B4 to the fourth pixel PX4 of the third dot DOT3.

In accordance with the exemplary embodiments illustrated in FIGS. 4A and 4B, during a fourth period in which the fourth control signal CLD is supplied, the switch unit 130 may couple the first output line B1 to the third pixel PX3 of the fourth dot DOT4, couple the second output line B2 to the second pixel PX2 of the third dot DOT3, couple the third output line B3 to the first pixel PX1 of the fourth dot DOT4, and couple the fourth output line B4 to the fourth pixel PX4 of the fourth dot DOT4.

The other configurations illustrated in FIGS. 4A and 4B, except the above-described connection relationship of the lines and the operations pertaining thereto, may be equal to each other.

Figure 5A:
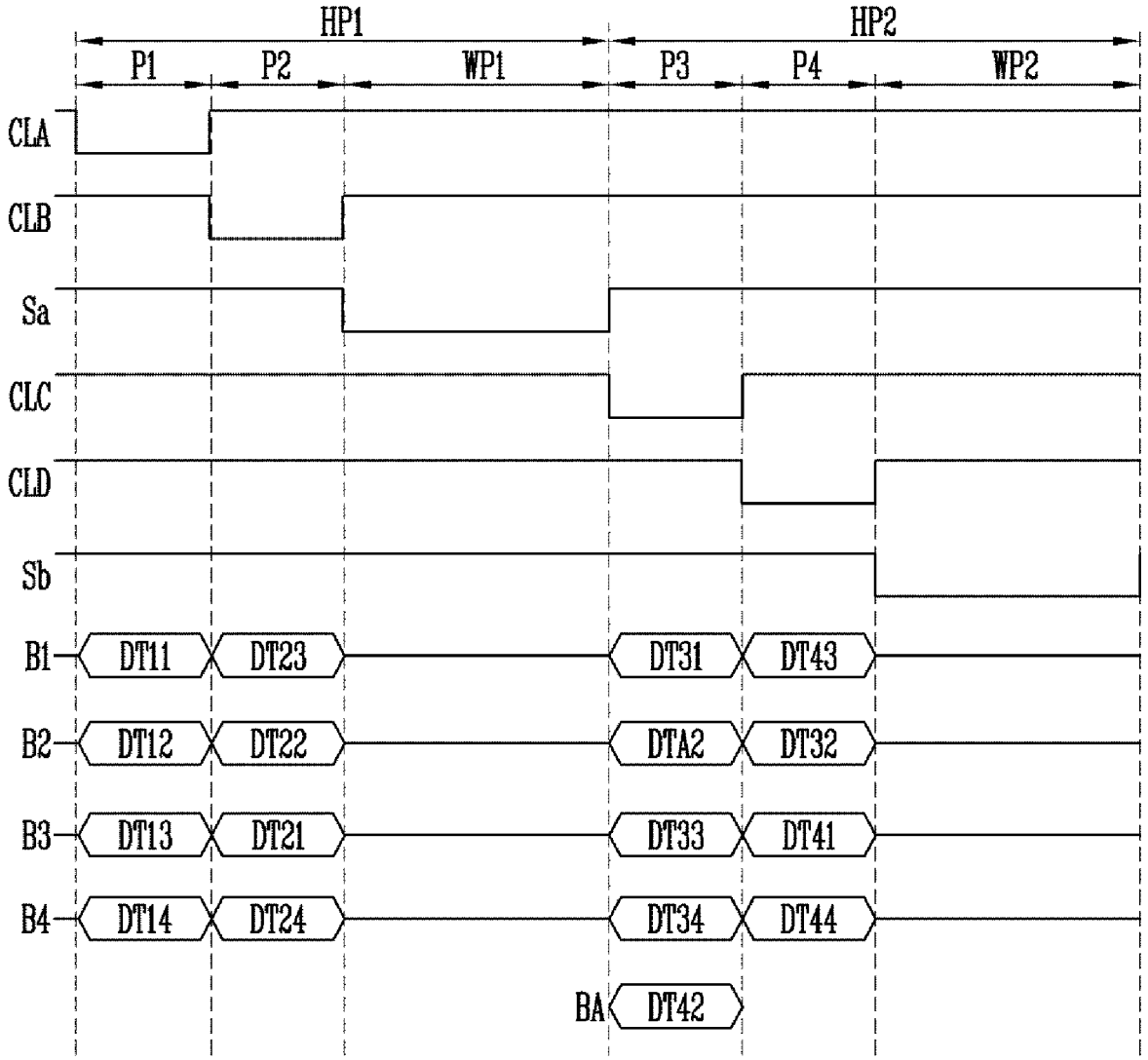
FIGS. 5A and 5B are signal diagrams illustrating methods of driving the display device in accordance with exemplary embodiments.
Figure 5B:
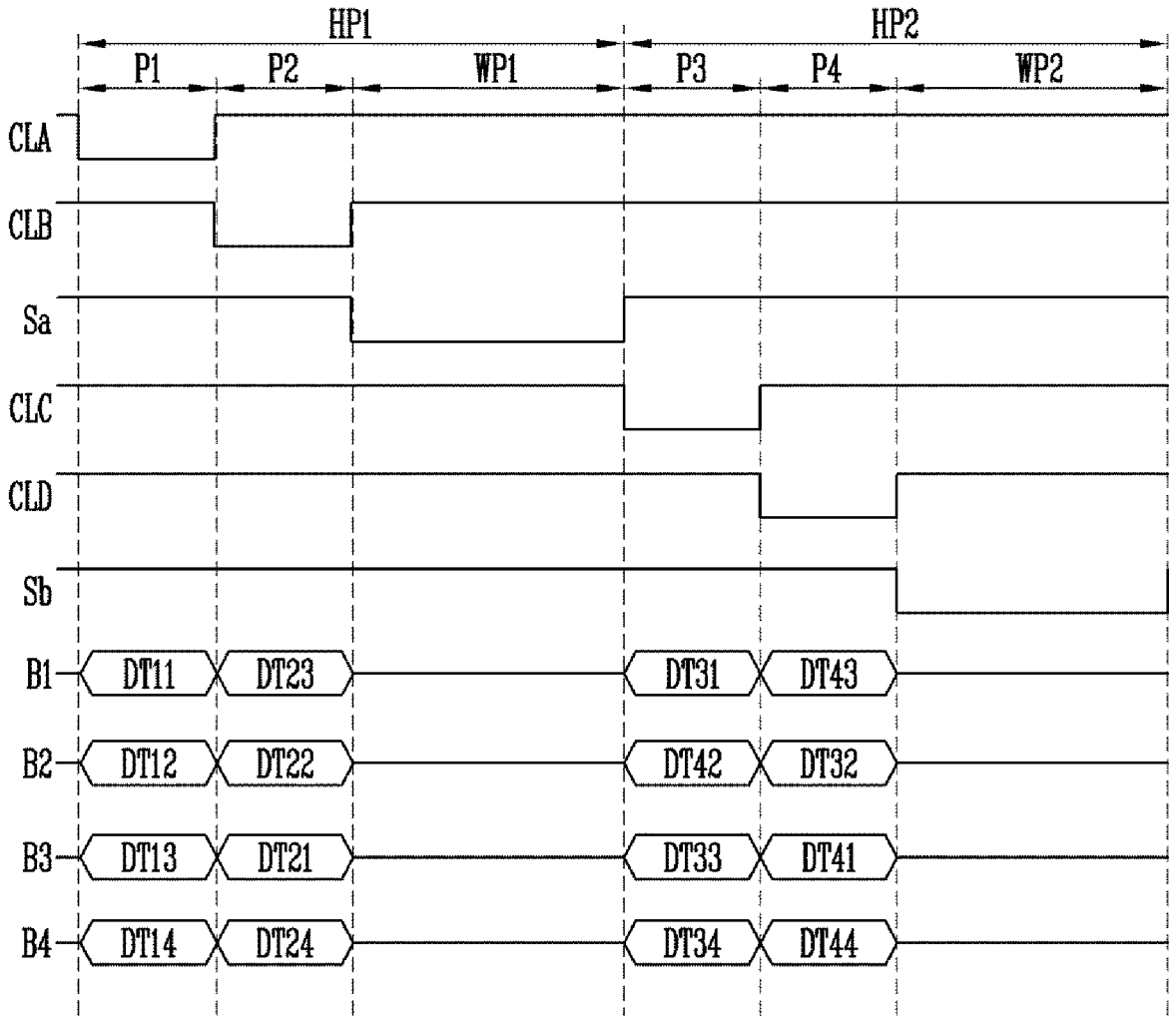

FIGS. 5A and 5B are signal diagrams illustrating methods of driving the display device in accordance with exemplary embodiments. FIG. 5A illustrates a method of driving the display device in accordance with the exemplary embodiment illustrated in FIG. 4A, and FIG. 5B illustrates a method of driving the display device in accordance with the exemplary embodiment illustrated in FIG. 4B.

Referring to FIGS. 5A and 5B, a first horizontal period HP1 may include a first period P1, a second period P2, and a first write period WP1, and a second horizontal period HP2 may include a third period P3, a fourth period P4, and a second write period WP2. For example, the first period P1, the second period P2, the first write period WP1, the third period P3, the fourth period P4, and the second write period WP2 may sequentially proceed.

In an exemplary embodiment, the second period P2 and the first write period WP1 may partially overlap with each other, and the fourth period P4 and the second write period WP2 may partially overlap with each other.

Hereinafter, a method of driving the display device in accordance with an exemplary embodiment will be described with reference to FIGS. 4A, 4B, 5A, and 5B.

During the first period P1, the first control signal CLA may be supplied.

Here, a data voltage DT11 may be supplied to the first pixel PX1 of the first dot DOT1 through the first output line B1. A data voltage DT12 may be supplied to the second pixel PX2 of the first dot DOT1 through the second output line B2. A data voltage DT13 may be supplied to the third pixel PX3 of the first dot DOT1 through the third output line B3. A data voltage DT14 may be supplied to the fourth pixel PX4 of the first dot DOT1 through the fourth output line B4.

During the second period P2, the second control signal CLB may be supplied.

Here, a data voltage DT23 may be supplied to the third pixel PX3 of the second dot DOT2 through the first output line B1. A data voltage DT22 may be supplied to the second pixel PX2 of the second dot DOT2 through the second output line B2. A data voltage DT21 may be supplied to the first pixel PX1 of the second dot DOT2 through the third output line B3. A data voltage DT24 may be supplied to the fourth pixel PX4 of the second dot DOT2 through the fourth output line B4.

During the first write period WP1, a scan signal may be supplied to the first scan line Sa.

In accordance with the exemplary embodiment illustrated in FIG. 5A, during the third period P3, the third control signal CLC may be supplied.

Here, a data voltage DT31 may be supplied to the first pixel PX1 of the third dot DOT3 through the first output line B1. A data voltage DTA2 may be supplied to the second pixel PX2 of the adjacent dot DOTA through the second output line B2. A data voltage DT33 may be supplied to the third pixel PX3 of the third dot DOT3 through the third output line B3. A data voltage DT34 may be supplied to the fourth pixel PX4 of the third dot DOT3 through the fourth output line B4. A data voltage DT42 may be supplied to the second pixel PX2 of the fourth dot DOT4 through the adjacent output line BA.

In accordance with the exemplary embodiment illustrated in FIG. 5B, during the third period P3, the third control signal CLC may be supplied.

Here, a data voltage DT31 may be supplied to the first pixel PX1 of the third dot DOT3 through the first output line B1. A data voltage DT42 may be supplied to the second pixel PX2 of the fourth dot DOT4 through the second output line B2. A data voltage DT33 may be supplied to the third pixel PX3 of the third dot DOT3 through the third output line B3. A data voltage DT34 may be supplied to the fourth pixel PX4 of the third dot DOT3 through the fourth output line B4.

In accordance with the exemplary embodiments illustrated in FIGS. 5A and 5B, during the fourth period P4, the fourth control signal CLD may be supplied.

Here, a data voltage DT43 may be supplied to the third pixel PX3 of the fourth dot DOT4 through the first output line B1. A data voltage DT32 may be supplied to the second pixel PX2 of the third dot DOT3 through the second output line B2. A data voltage DT41 may be supplied to the first pixel PX1 of the fourth dot DOT4 through the third output line B3. A data voltage DT44 may be supplied to the fourth pixel PX4 of the fourth dot DOT4 through the fourth output line B4.

During the second write period WP2, a scan signal may be supplied to the second scan line Sb.

The other operations of the methods of driving the display device illustrated in FIGS. 5A and 5B, except the above-described operations, may be equal to each other.

Figure 6:
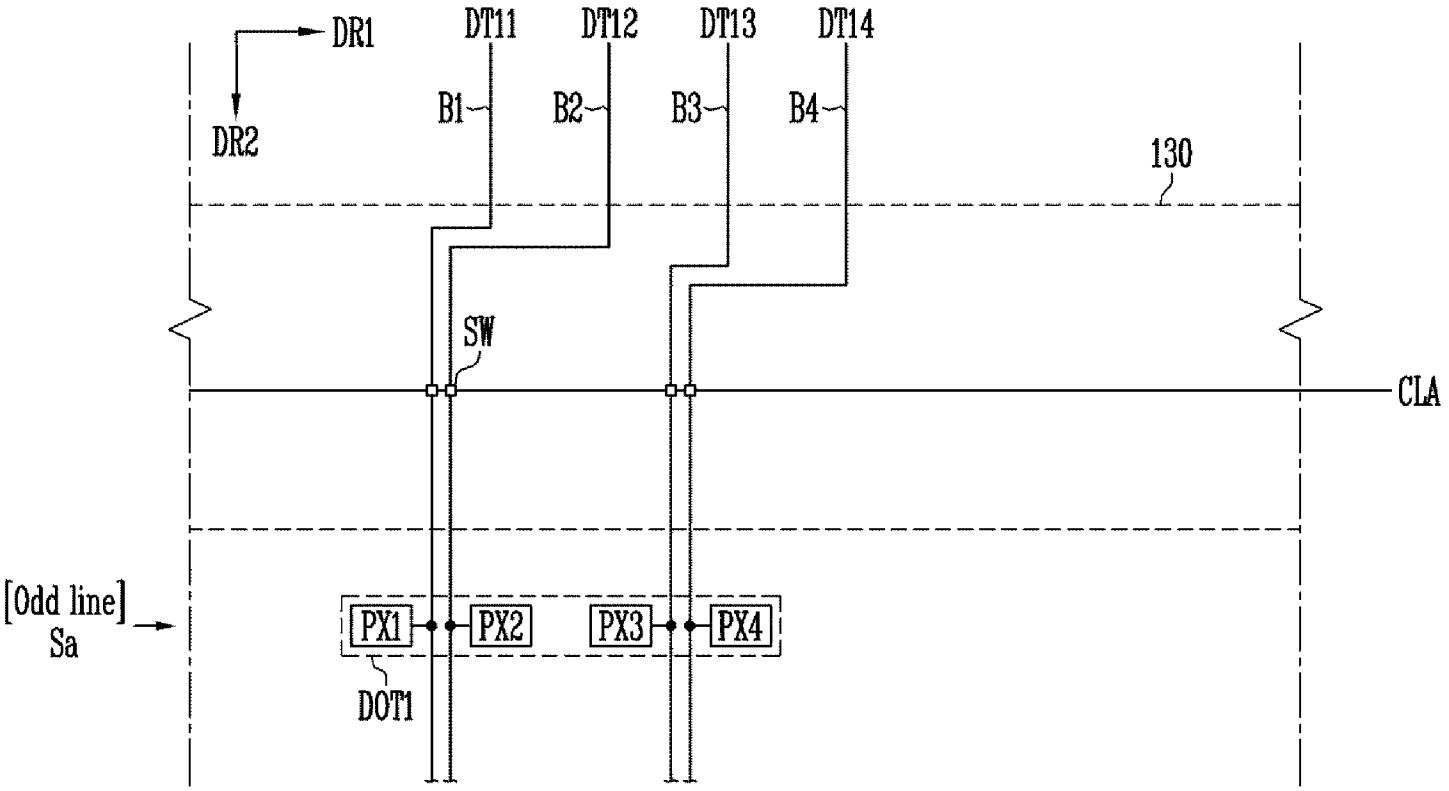
FIG. 6 is a circuit diagram illustrating a method of driving the display device during a first period in accordance with an exemplary embodiment.

FIG. 6 is a circuit diagram illustrating a method of driving the display device during the first period in accordance with an exemplary embodiment.

Referring to FIGS. 1, 2, 3, 4, 5, and 6, during the first period in which the first control signal CLA is supplied, the switch unit 130 may couple the first output line B1 to the first pixel PX1 of the first dot DOT1, couple the second output line B2 to the second pixel PX2 of the first dot DOT1, couple the third output line B3 to the third pixel PX3 of the first dot DOT1, and couple the fourth output line B4 to the fourth pixel PX4 of the first dot DOT1.

Here, the data voltage DT11 may be supplied to the first pixel PX1 of the first dot DOT1 through the first output line B1. The data voltage DT12 may be supplied to the second pixel PX2 of the first dot DOT1 through the second output line B2. The data voltage DT13 may be supplied to the third pixel PX3 of the first dot DOT1 through the third output line B3. The data voltage DT14 may be supplied to the fourth pixel PX4 of the first dot DOT1 through the fourth output line B4.

Figure 7:
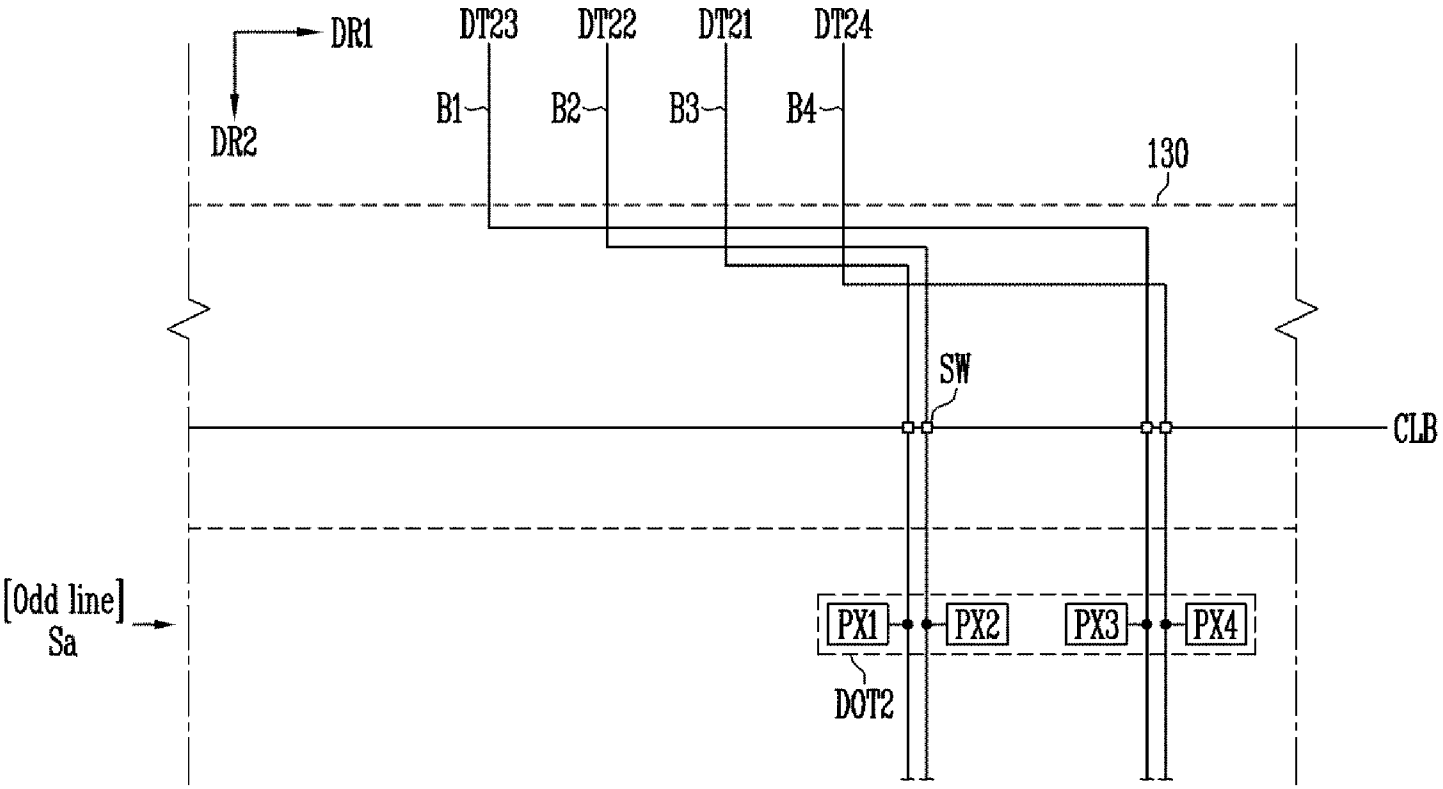
FIG. 7 is a circuit diagram illustrating a method of driving the display device during a second period in accordance with an exemplary embodiment.

FIG. 7 is a circuit diagram illustrating a method of driving the display device during the second period in accordance with an exemplary embodiment.

Referring to FIGS. 1, 2, 3, 4A, 4B, 5A, 5B, and 7, during the second period in which the second control signal CLB is supplied, the switch unit 130 may couple the first output line B1 to the third pixel PX3 of the second dot DOT2, couple the second output line B2 to the second pixel PX2 of the second dot DOT2, couple the third output line B3 to the first pixel PX1 of the second dot DOT2, and couple the fourth output line B4 to the fourth pixel PX4 of the second dot DOT2.

Here, the data voltage DT23 may be supplied to the third pixel PX3 of the second dot DOT2 through the first output line B1. The data voltage DT22 may be supplied to the second pixel PX2 of the second dot DOT2 through the second output line B2. The data voltage DT21 may be supplied to the first pixel PX1 of the second dot DOT2 through the third output line B3. The data voltage DT24 may be supplied to the fourth pixel PX4 of the second dot DOT2 through the fourth output line B4.

Figure 8A:
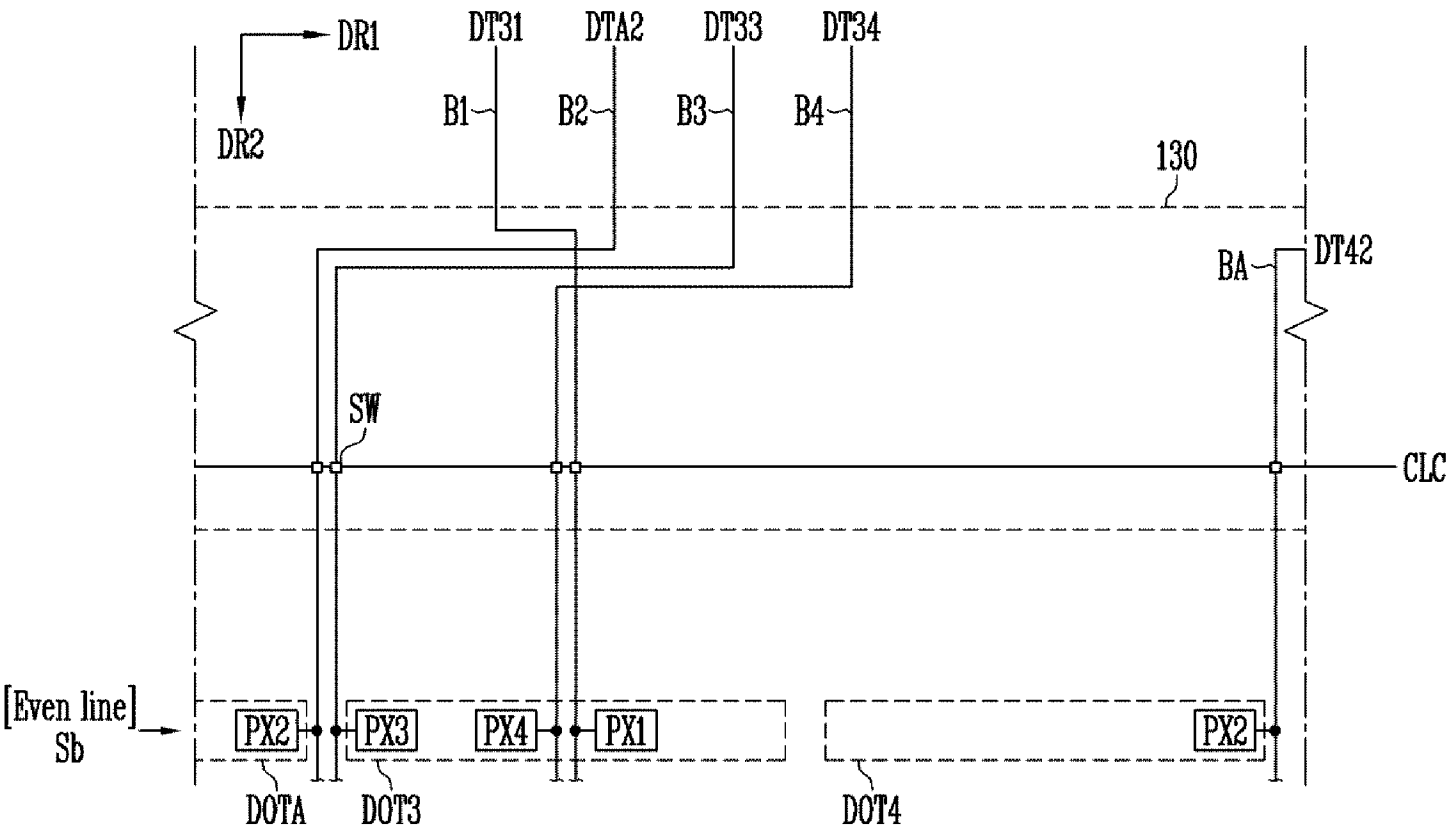
FIGS. 8A and 8B are circuit diagrams illustrating methods of driving the display device during a third period in accordance with an exemplary embodiment.
Figure 8B:
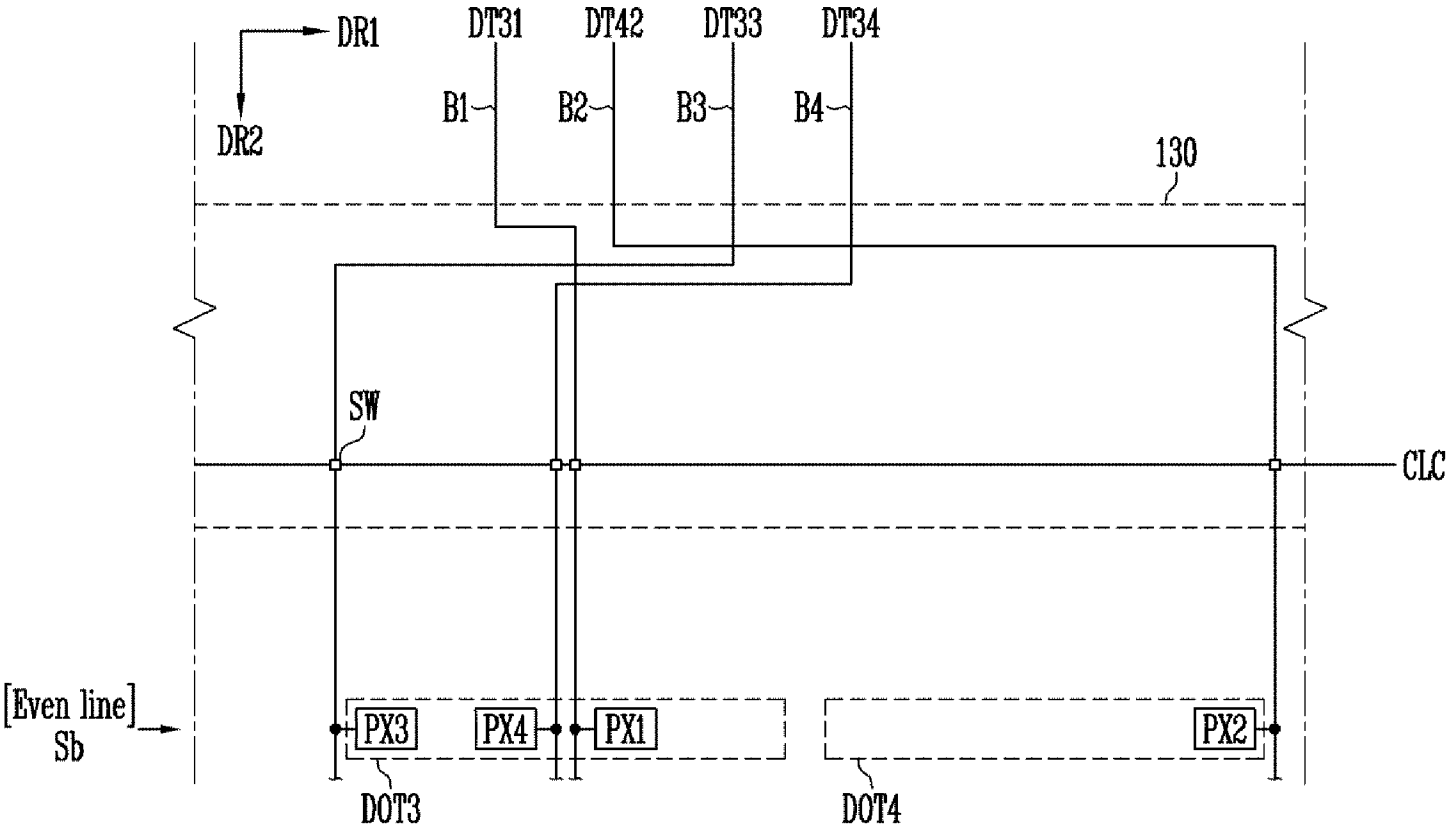

FIGS. 8A and 8B are circuit diagrams illustrating methods of driving the display device during the third period in accordance with an exemplary embodiment. FIG. 8A illustrates a method of driving the display device during the third period in accordance with the exemplary embodiment illustrated in FIG. 4A, and FIG. 8B illustrates a method of driving the display device during the third period in accordance with the exemplary embodiment illustrated in FIG. 4B.

Referring to FIGS. 1, 2, 3, 4A, 4B, 5A, 5B, and 8A, during the third period in which the third control signal CLC is supplied, the switch unit 130 may couple the first output line B1 to the first pixel PX1 of the third dot DOT3, couple the second output line B2 to the second pixel PX2 of an adjacent dot DOTA, couple the third output line B3 to the third pixel PX3 of the third dot DOT3, couple the fourth output line B4 to the fourth pixel PX4 of the third dot DOT3, and couple the adjacent output line BA to the second pixel PX2 of the fourth dot DOT4.

Here, the data voltage DT31 may be supplied to the first pixel PX1 of the third dot DOT3 through the first output line B1. The data voltage DTA2 may be supplied to the second pixel PX2 of the adjacent dot DOTA through the second output line B2. The data voltage DT33 may be supplied to the third pixel PX3 of the third dot DOT3 through the third output line B3. The data voltage DT34 may be supplied to the fourth pixel PX4 of the third dot DOT3 through the fourth output line B4. The data voltage DT42 may be supplied to the second pixel PX2 of the fourth dot DOT4 through the adjacent output line BA.

Referring to FIGS. 1, 2, 3, 4A, 4B, 5A, 5B, and 8B, during the third period in which the third control signal CLC is supplied, the switch unit 130 may couple the first output line B1 to the first pixel PX1 of the third dot DOT3, couple the second output line B2 to the second pixel PX2 of the fourth dot DOT4, couple the third output line B3 to the third pixel PX3 of the third dot DOT3, and couple the fourth output line B4 to the fourth pixel PX4 of the third dot DOT3.

Here, the data voltage DT31 may be supplied to the first pixel PX1 of the third dot DOT3 through the first output line B1. The data voltage DT42 may be supplied to the second pixel PX2 of the fourth dot DOT4 through the second output line B2. The data voltage DT33 may be supplied to the third pixel PX3 of the third dot DOT3 through the third output line B3. The data voltage DT34 may be supplied to the fourth pixel PX4 of the third dot DOT3 through the fourth output line B4.

Figure 9:
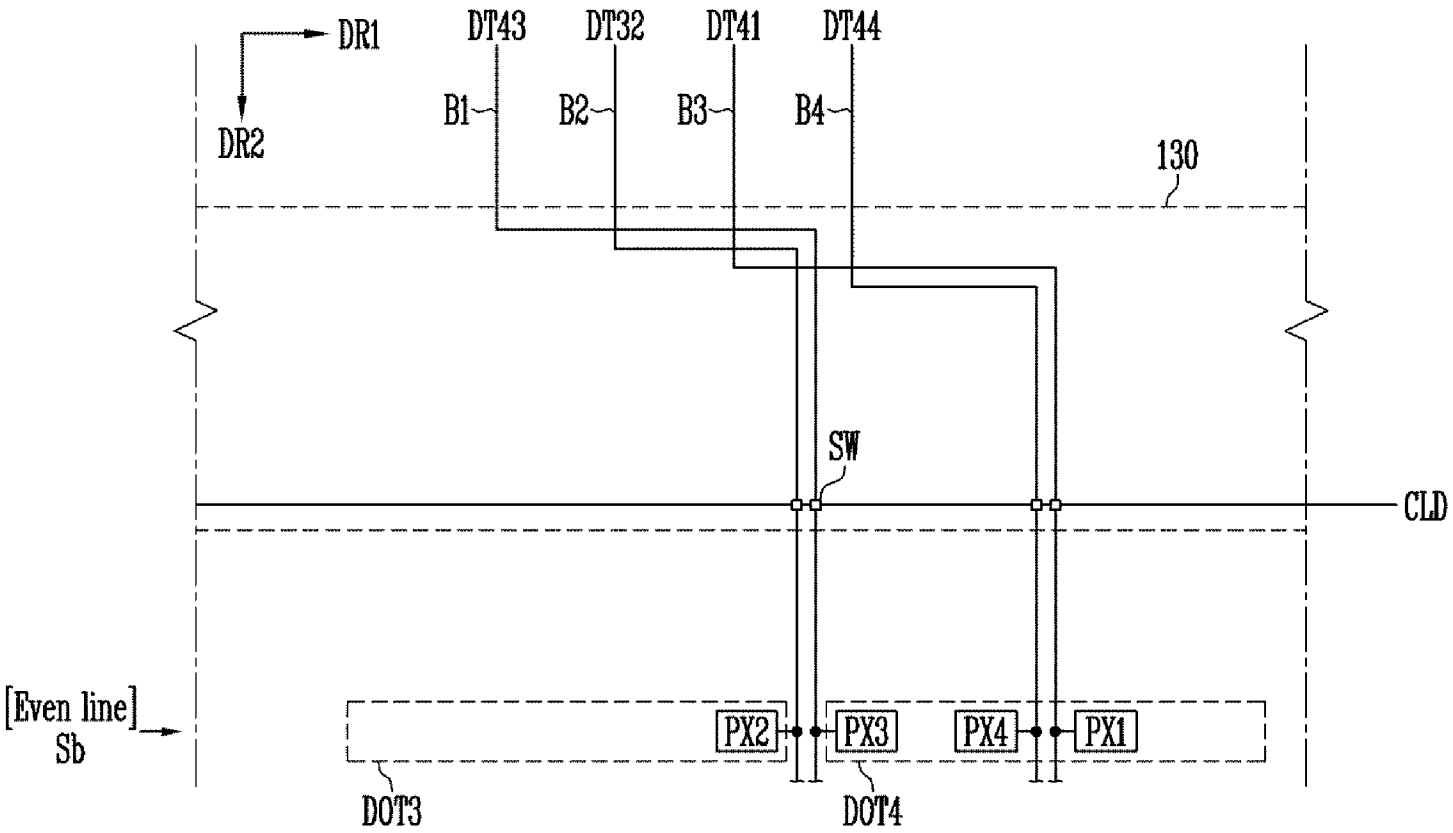
FIG. 9 is a circuit diagram illustrating a method of driving the display device during a fourth period in accordance with an exemplary embodiment.

FIG. 9 is a circuit diagram illustrating a method of driving the display device during the fourth period in accordance with an exemplary embodiment.

Referring to FIGS. 1, 2, 3, 4A, 4B, 5A, 5B, and 9, during the fourth period in which the fourth control signal CLD is supplied, the switch unit 130 may couple the first output line B1 to the third pixel PX3 of the fourth dot DOT4, couple the second output line B2 to the second pixel PX2 of the third dot DOT3, couple the third output line B3 to the first pixel PX1 of the fourth dot DOT4, and couple the fourth output line B4 to the fourth pixel PX4 of the fourth dot DOT4.

Here, the data voltage DT43 may be supplied to the third pixel PX3 of the fourth dot DOT4 through the first output line B1. The data voltage DT32 may be supplied to the second pixel PX2 of the third dot DOT3 through the second output line B2. The data voltage DT41 may be supplied to the first pixel PX1 of the fourth dot DOT4 through the third output line B3. The data voltage DT44 may be supplied to the fourth pixel PX4 of the fourth dot DOT4 through the fourth output line B4.

Figure 10:
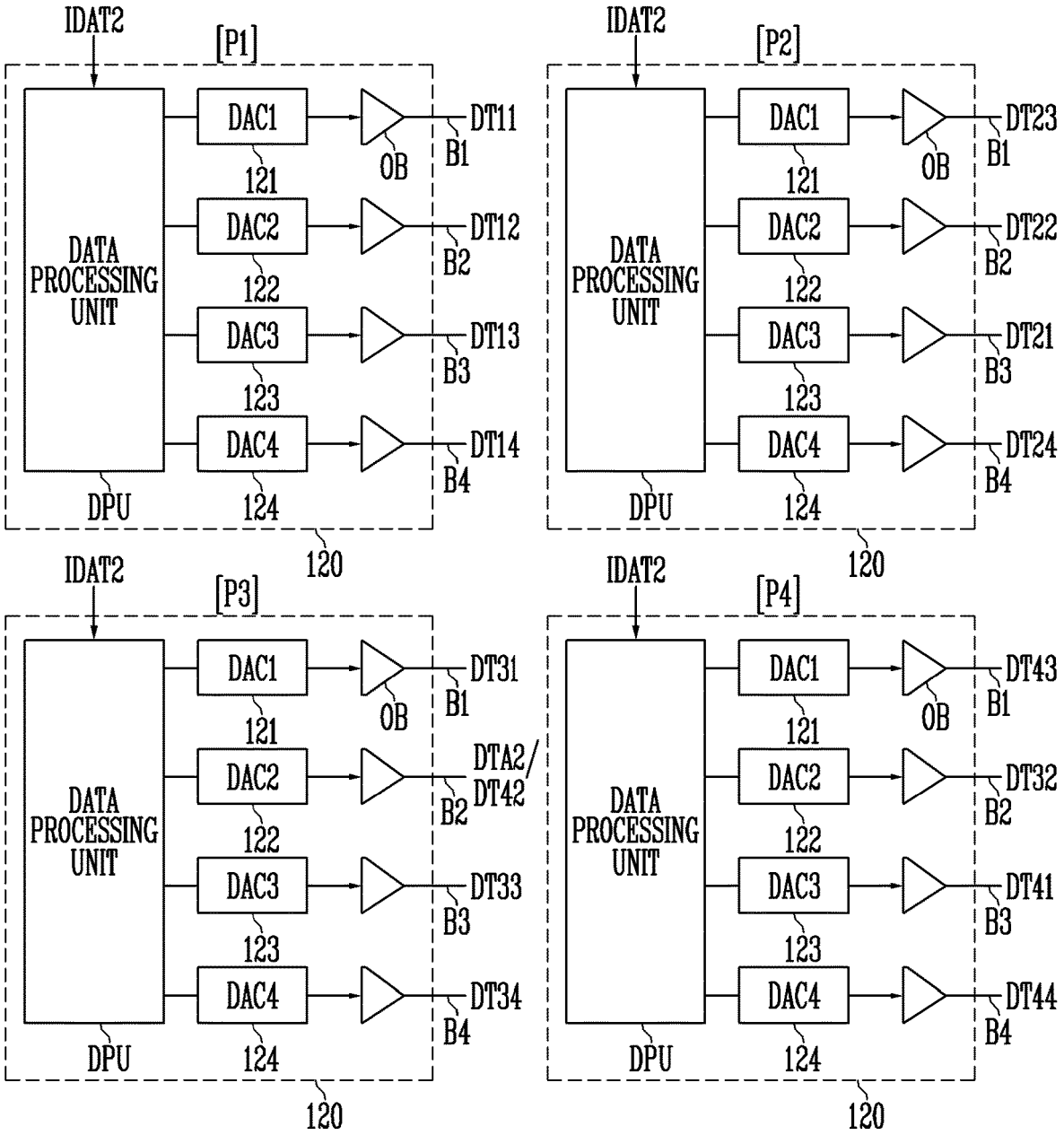
FIG. 10 is a block diagram illustrating a data driver in accordance with an exemplary embodiment.

FIG. 10 is a block diagram illustrating the data driver 120 in accordance with an exemplary embodiment.

Referring to FIGS. 1, 2, 3, 4, 5, 6, 7, 8, 9, and 10, the data driver 120 may include a data processing unit DPU, first to fourth digital-to-analog converters (DACs) 121, 122, 123, and 124, and output buffers OB.

The data processing unit (also referred to as a data processor) DPU may receive the second data IDAT2. The data processing unit DPU may parallel-process the second data IDAT2 and allocate the parallel-processed second data IDAT2 to the first to fourth output lines B1, B2, B3, and B4.

The first to fourth DACs 121, 122, 123, and 124 may convert parallel-processed digital data signals into analog data voltages.

Each of the first to fourth DACs 121, 122, 123, and 124 may be supplied with a corresponding one of first to fourth gamma voltages. Here, first gamma voltages may correspond to a first color, second gamma voltages may correspond to a second color, third gamma voltages may correspond to a third color, and fourth gamma voltages may correspond to a fourth color.

In detail, the first DAC 121 may convert a data signal into a data voltage using the first gamma voltages. The second DAC 122 may convert a data signal into a data voltage using the second gamma voltages. The third DAC 123 may convert a data signal into a data voltage using the third gamma voltages. The fourth DAC 124 may convert a data signal into a data voltage using the fourth gamma voltages.

For example, during the first period P1, the first DAC 121 may supply, to the first output line B1, a data voltage DT11 to be applied to the first pixel PX1 of the first dot DOT1. The second DAC 122 may supply, to the second output line B2, a data voltage DT12 to be applied to the second pixel PX2 of the first dot DOT1. The third DAC 123 may supply, to the third output line B3, a data voltage DT13 to be applied to the third pixel PX3 of the first dot DOT1. The fourth DAC 124 may supply, to the fourth output line B4, a data voltage DT14 to be applied to the fourth pixel PX4 of the first dot DOT1.

During the second period P2, the first DAC 121 may supply, to the first output line B1, a data voltage DT23 to be applied to the third pixel PX3 of the second dot DOT2. The second DAC 122 may supply, to the second output line B2, a data voltage DT22 to be applied to the second pixel PX2 of the second dot DOT2. The third DAC 123 may supply, to the third output line B3, a data voltage DT21 to be applied to the first pixel PX1 of the second dot DOT2. The fourth DAC 124 may supply, to the fourth output line B4, a data voltage DT24 to be applied to the fourth pixel PX4 of the second dot DOT2.

During the third period P3, the first DAC 121 may supply, to the first output line B1, a data voltage DT31 to be applied to the first pixel PX1 of the third dot DOT3. The second DAC 122 may supply, to the second output line B2, a data voltage DTA2 to be applied to the second pixel PX2 (refer to FIG. 4A) of the adjacent dot DOTA, or may supply, to the second output line B2, a data voltage DT42 to be applied to the second pixel PX2 (refer to FIG. 4B) of the fourth dot DOT4. The third DAC 123 may supply, to the third output line B3, a data voltage DT33 to be applied to the third pixel PX3 of the third dot DOT3. The fourth DAC 124 may supply, to the fourth output line B4, a data voltage DT34 to be applied to the fourth pixel PX4 of the third dot DOT3.

During the fourth period P4, the first DAC 121 may supply, to the first output line B1, a data voltage DT43 to be applied to the third pixel PX3 of the fourth dot DOT4. The second DAC 122 may supply, to the second output line B2, a data voltage DT32 to be applied to the second pixel PX2 of the third dot DOT3. The third DAC 123 may supply, to the third output line B3, a data voltage DT41 to be applied to the first pixel PX1 of the fourth dot DOT4. The fourth DAC 124 may supply, to the fourth output line B4, a data voltage DT44 to be applied to the fourth pixel PX4 of the fourth dot DOT4.

The output buffers OB may receive the data voltages and apply the received data voltages to the first to fourth output lines B1, B2, B3, and B4. For example, the output buffers OB may scale up the data voltages and apply the scaled-up data voltages to the first to fourth output lines B1, B2, B3, and B4.

Since the data driver 120 is driven in the above-mentioned manner, data voltages suitable for colors of respective pixels may be allocated to the first to fourth output lines B1, B2, B3, and B4.

Each of the first to fourth DACs 121, 122, 123, and 124 of the display device 100 including the pixels PX arranged in a pentile structure in accordance with an exemplary embodiment may continuously perform a digital-analog conversion operation using a gamma voltage with respect to a corresponding single color. Consequently, a separate gamma voltage switching operation is not required, whereby the power consumption may be reduced, and logic may be simplified.

Furthermore, in the display device having a structure in which two data lines are disposed between two adjacent pixels in accordance with an exemplary embodiment, cross-talk between the data lines may be prevented or reduced from being generated.

Although certain exemplary embodiments and implementations have been described herein, other embodiments and modifications will be apparent from this description. Accordingly, the inventive concepts are not limited to such embodiments, but rather to the broader scope of the appended claims and various obvious modifications and equivalent arrangements as would be apparent to a person of ordinary skill in the art.

What is claimed is:

1. A display device, comprising:

first to eighth pixels successively arranged in a first direction on a first horizontal line;

ninth to sixteenth pixels successively arranged in the first direction on a second horizontal line, the second horizontal line being adjacent to the first horizontal line in a second direction different from the first direction;

first to sixteenth data lines each extending in the second direction and successively arranged in the first direction; and a data driver configured to supply data voltages to a first output line, a second output line, a third output line, and a fourth output line, wherein:

the second data line is disposed between the first pixel and the second pixel and connected to the first pixel;

the third data line is disposed between the first pixel and the second pixel and connected to the second pixel;

the sixth data line is disposed between the third pixel and the fourth pixel and connected to the third pixel;

the seventh data line is disposed between the third pixel and the fourth pixel and connected to the fourth pixel;

the tenth data line is disposed between the fifth pixel and the sixth pixel and connected to the fifth pixel;

the eleventh data line is disposed between the fifth pixel and the sixth pixel and connected to the sixth pixel;

the fourteenth data line is disposed between the seventh pixel and the eighth pixel and connected to the seventh pixel;

the fifteenth data line is disposed between the seventh pixel and the eighth pixel and connected to the eighth pixel; and each of the first to fifteenth data lines is configured to be connected to at least one of the first, second, third, and fourth output lines.

2. The display device according to claim 1, wherein:

the ninth pixel is adjacent to the first pixel in the second direction;

the tenth pixel is adjacent to the second pixel in the second direction;

the eleventh pixel is adjacent to the third pixel in the second direction;

the twelfth pixel is adjacent to the fourth pixel in the second direction;

the thirteenth pixel is adjacent to the fifth pixel in the second direction;

the fourteenth pixel is adjacent to the sixth pixel in the second direction;

the fifteenth pixel is adjacent to the seventh pixel in the second direction; and the sixteenth pixel is adjacent to the eighth pixel in the second direction.

3. The display device according to claim 1, wherein:

the first data line is disposed on one side of the ninth pixel and connected to the ninth pixel;

the fourth data line is disposed between the tenth pixel and the eleventh pixel and connected to the tenth pixel;

the fifth data line is disposed between the tenth pixel and the eleventh pixel and connected to the eleventh pixel;

the eighth data line is disposed between the twelfth pixel and the thirteenth pixel and connected to the twelfth pixel;

the ninth data line is disposed between the twelfth pixel and the thirteenth pixel and connected to the thirteenth pixel;

the twelfth data line is disposed between the fourteenth pixel and the fifteenth pixel and connected to the fourteenth pixel;

the thirteenth data line is disposed between the fourteenth pixel and the fifteenth pixel and connected to the fifteenth pixel; and the sixteenth data line is disposed on one side of the sixteenth pixel and connected to the sixteenth pixel.

4. The display device according to claim 3, wherein each of the first to fourth output lines extends in the second direction and the first to fourth output lines are successively arranged in the first direction.

5. The display device according to claim 3, further comprising a switch unit configured to selectively connect the first output line, the second output line, the third output line, and the fourth output line to the first to sixteenth data lines.

6. The display device according to claim 5, wherein the switch unit is configured to connect the first output line to one of the second data line, the fifth data line, the ninth data line, and the fourteenth data line.

7. The display device according to claim 5, wherein the switch unit is configured to connect the second output line to one of the third data line, the eighth data line, the eleventh data line, and the sixteenth data line.

8. The display device according to claim 5, wherein the switch unit is configured to connect the third output line to one of the first data line, the sixth data line, the tenth data line, and the thirteenth data line.

9. The display device according to claim 5, wherein the switch unit is configured to connect the fourth output line to one of the fourth data line, the seventh data line, the twelfth data line, and the fifteenth data line.

10. The display device according to claim 5, wherein the switch unit comprises a first switch, a second switch, a third switch, and a fourth switch configured to selectively connect the first output line, the second output line, the third output line and the fourth output line to the second data line, the third data line, the sixth data line, and the seventh data line, respectively, in response to a first control signal.

11. The display device according to claim 5, wherein the switch unit comprises a fifth switch, a sixth switch, a seventh switch and a eighth switch configured to selectively connect the first output line, the second output line, the third output line and the fourth output line to the fourteenth data line, the eleventh data line, the tenth data line, and the fifteenth data line, respectively, in response to a second control signal.

12. The display device according to claim 5, wherein the switch unit comprises a ninth switch, a tenth switch, a eleventh switch and a twelfth switch configured to selectively connect the first output line, the second output line, the third output line and the fourth output line to the fifth data line, the sixteenth data line, the first data line, and the fourth data line, respectively, in response to a third control signal.

13. The display device according to claim 5, wherein the switch unit comprises a thirteenth switch, a fourteenth switch, a fifteenth switch and a sixteenth switch configured to selectively connect the first output line, the second output line, the third output line and the fourth output line to the ninth data line, the eighth data line, the thirteenth data line, and the twelfth data line, respectively, in response to a third control signal.

14. The display device according to claim 1, further comprising:

a first dot comprising the first pixel, the second pixel, the third pixel, and the fourth pixel;

a second dot adjacent to the first dot in the first direction and comprising the fifth pixel, the sixth pixel, the seventh pixel, and the eighth pixel;

a third dot comprising the ninth pixel, the tenth pixel, the eleventh pixel, and the twelfth pixel; and a fourth dot adjacent to the third dot in the first direction and comprising the thirteenth pixel, the fourteenth pixel, the fifteenth pixel, and the sixteenth pixel.

15. The display device according to claim 14, wherein:

the third dot is adjacent to the first dot in the second direction; and the fourth dot is adjacent to the second dot in the second direction.

16. The display device according to claim 1, wherein the sixteenth data line is configured to be connected to at least one of the first, second, third, and fourth output lines.

* * * * *